United States Patent [19]

Kollberg et al.

[11] Patent Number: 4,735,256

[45] Date of Patent: Apr. 5, 1988

[54] HEATING APPARATUS FOR INTERMEDIATE LADLES OR TUNDISHES

[75] Inventors: Sten Kollberg; Yngve Sundberg, both of Vasteras, Sweden

[73] Assignee: ASEA AB, Vasteras, Sweden

[21] Appl. No.: 828,950

[22] Filed: Feb. 12, 1986

[30] Foreign Application Priority Data

Feb. 21, 1985 [SE] Sweden ..... 8500839-9

[51] Int. Cl.[4] ..... B22D 11/10

[52] U.S. Cl. ..... 164/507; 164/513; 164/437

[58] Field of Search ..... 164/48, 133, 141, 147.1, 164/250.1, 335, 437, 466, 471, 488, 492, 493, 498, 502, 505, 507, 513; 222/592, 593; 266/242, 275

[56] References Cited

U.S. PATENT DOCUMENTS

| | | | |
|---|---|---|---|
| 3,998,264 | 12/1976 | Hocking | 266/242 |
| 4,562,943 | 1/1986 | Freytag | 222/592 |

FOREIGN PATENT DOCUMENTS

| | | | |
|---|---|---|---|
| 119853A | 9/1984 | European Pat. Off. | 164/335 |
| 47-34579 | 8/1972 | Japan | 164/471 |
| 57-56143 | 4/1982 | Japan | 164/471 |
| 57-103762 | 6/1982 | Japan | 164/437 |
| 570452 | 8/1977 | U.S.S.R. | 164/133 |
| 1101327 | 7/1984 | U.S.S.R. | 164/466 |

*Primary Examiner*—Nicholas P. Godici
*Assistant Examiner*—Richard K. Seidel
*Attorney, Agent, or Firm*—Kenyon & Kenyon

[57] ABSTRACT

Apparatus for heating intermediate ladles or tundishes, for example, in continuous casting processes. The apparatus comprises at least one coil having an iron core, which is disposed adjacent the ladle or tundish. The ladle or tundish and the coils are arranged so as to be movable with respect to each other. The ladle or tundish is adapted to be placed in a heating position adjacent to the coil, which is thus closely connected with the bottom or lower parts or corners of the ladle or tundish, in order primarily to heat the lowermost parts of the melt stored in the tundish.

7 Claims, 1 Drawing Sheet

HEATING APPARATUS FOR INTERMEDIATE LADLES OR TUNDISHES

BACKGROUND OF THE INVENTION

The present invention relates to a device for the heating of intermediate ladles, also known as tundishes, for example, in continuous casting processes.

In tundish heating, the requirements are, inter alia, the following:

1. A considerable power feed, for example 1-3 MW;
2. The steel meniscus must not be "disturbed" (stirred);
3. A stationary installation, without cables and the like on the floor is desirable;
4. To the greatest possible extent, it is desirable to maintain a conventional shape for the intermediate ladle or tundish and to apply the normal lining practice.

In other words, the heating should be carried out in such a way that, inter alia, the above conditions are fulfilled.

SUMMARY OF THE INVENTION

It is an object of the present invention to provide an apparatus for heating intermediate ladles or tundishes which satisfies the above requirements.

It is furthermore an object of the present invention to provide an apparatus for allowing the melt in intermediate ladles or tundishes to be uniformly heated.

The above and other objects are achieved by an apparatus for heating intermediate ladles which comprises at least one electric coil having an iron core disposed adjacent the ladle or tundish, the coil and ladle or tundish being arranged movably with respect to each other, the ladle or tundish being adapted to be placed in a heating position adjacent the coil, the coil generating an electromagnetic field and being arranged in close proximity with the bottom and lower portions of the ladle or tundish, and being provided to heat the lowermost parts of the melt stored in the ladle or tundish.

Thus, the heating is performed in the bottom or in the lower parts or the corners of the ladle or tundish, and the ladle and heating device are movable with respect to each other. The heating can be applied to intermediate ladles of all kinds, for example, of a kind disclosed in European patent application No. 85101148.6, also owned by the assignee of this application.

BRIEF DESCRIPTION OF THE DRAWINGS

The invention will be described in greater detail in the following description with reference to the accompanying drawings, wherein.

DETAILED DESCRIPTION

Figure 1:
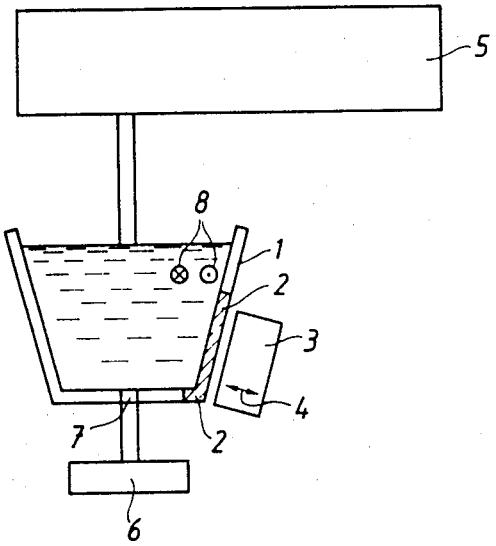
FIG. 1 shows heating of a ladle according to the invention, the ladle being of the type shown in the abovementioned European patent application.

FIG. 1 shows heating of the lower part of a ladle or tundish 1. In this case, the heated part 2 of the walls of the ladle 1 is not constructed in the usual manner of steel framework and bricks, but instead this part 2 forms a window which is made of a lining compound and at least one of cement, concrete, a ceramic compound and possibly fibre, as well as a reinforcement which is arranged so as not to form part of a closed electrical or magnetic circuit. The rest of the ladle 1 is made of conventional material. The heating is designed to be accomplished by one or more coils 3, for example pancake coils. The coils and ladle are movable with respect to each other. For example, the coils may be disposed movably on a support vehicle, are movable in some other way (see arrow 4), or are mounted directly on the ladle 1. Alternatively, the ladle may be movable. In the case of a movable ladle 1, the coil 3 can be placed close to the ladle 1, and the field from the coil 3 penetrates relatively easily through the part 2 of the ladle 1, and heating of the molten metal in the ladle 1 is performed by electromagnetic induction.

Molten metal is tapped from an upper ladle or furnace 5, and teeming from the tundish 1 can be performed freely at the bottom 7 down into a mold 6, for example, for continuous casting. The directions of the induced currents are exemplified at 8.

Figure 2:
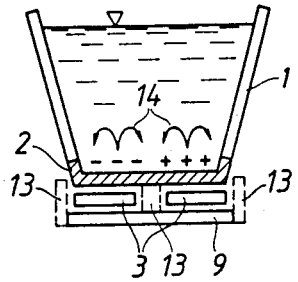
FIG. 2 shows bottom heating.

Another embodiment of the heating device is shown in FIG. 2, in which one or more coils 3 are placed below the whole ladle bottom. In this case, the heating can be started as soon as the lowermost bottom has been filled with molten metal. A minimum influence on the melt surface will be exerted by the coil 3. 9 designates an iron core. A hole for a casting tube may be made in the coil 3. The iron core 9 may be provided with "noses" 13 for reduced leakage. The flow is shown by the arrows 14. The window 2 permeable to the magnetic field may be as indicated.

The distance from the tundish 1 to the mold 6 can be made to be minimal. This has been achieved especially in an embodiment according to FIG. 3, in which coils 3 with iron cores 15 have been placed around the corners 10 of the ladle 1. The coil 3 may be of annular configuration. The windows 2 permeable to the magnetic field may be as shown.

Figure 3:
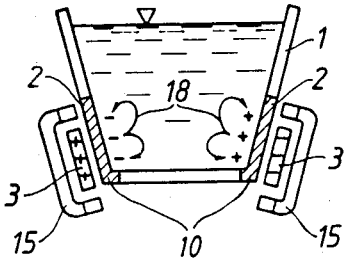
FIG. 3 shows heating at the lower corners.

Both in the embodiments of FIG. 2 and FIG. 3, the ladle 1 can be lifted into and out of an underlying base supported by means of the coils 3, or the coils 3 can be made movable relative to the ladle 1. This, of course, also applies to the embodiment shown in FIG. 1.

The ladle 1 according to FIG. 2 may, for example, be pushed out laterally without the need of a lifting operation.

Figure 4:
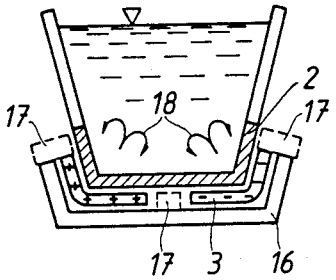
FIG. 4 shows an alternative bottom heating arrangement.

A combination of the embodiments according to FIGS. 2 and 3 is shown in FIG. 4, in which the coil or coils 3 have been formed around the corners of the ladle and in which the iron core 16 may be provided with "noses" 17. The flow is shown at 18 (see also FIG. 3), and the window 2 may be as shown.

Figure 5:
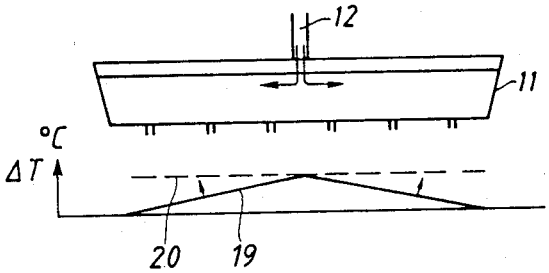
FIG. 5 shows schematically the feeding of molten metal into a tundish and a graph of the temperature distribution before and after heating according to the invention.

FIG. 5 shows casting into a plurality of molds from a single tundish 11. The power feed to the tundish can be constant per unit of length. $\Delta T$ is the overtemperature in degrees centigrade. Molten metal, tapped from an upper ladle or furnace (not indicated) is shown by 12. The curve 19 drawn in a continuous line shows the temperature distribution without heating according to the invention. The dashed line 20 shows the desired temperature distribution, obtained by means of heating according to the invention. Heating takes place in the outer parts of the tundish in order to achieve temperature curve 20. The coil or coils 3 are preferably supplied with single-phase current having a frequency of 50 Hz.

The devices according to the foregoing description may be supplemented with coils which substantially cover the intermediate ladle, in which case the whole ladle should suitably be made of magnetic field permeable material. It is possible to postpone the heating from the bottom and allow the heating to be carried out only from above, and it is possible to wait until the ladle is half-filled before the heating is switched on. It may also be sufficient to heat this material only when it is near the coils.

In the foregoing specification, the invention has been described with reference to specific exemplary embodiments thereof. It will, however, be evident that various modifications and changes may be made thereunto without departing from the broader spirit and scope of the invention as set forth in the appended claims. The specification and drawings are, accordingly, to be regarded in an illustrative rather than in a restrictive sense.

What is claimed is:

1. A continuous casting apparatus comprising a ladle containing the melt being cast, a tundish below the ladle and receiving melt tapped from the ladle, and a mold below the tundish and receiving melt teemed from the tundish, the tundish having solid side walls and a solid bottom wall at least one of which forms a magnetically permeable window in the lower portion of the tundish, and an electric induction coil positioned to project its field through the window and into the melt in the lower portion of the tundish, the tundish and coil being mechanically free from each other and either being movable independently from the other.

2. The apparatus recited in claim 1, wherein the coil is disposed under the bottom of the tundish and around a central hole for tapping melt from the tundish.

3. The apparatus recited in claim 1, wherein the coil is disposed along the lower walls of the tundish and around the lower corners thereof, the coil being at least partially surrounded by an iron core.

4. The apparatus recited in claim 1, wherein the tundish wall adjacent the coil comprises at least in part of a ceramic material.

5. The apparatus recited in claim 1, wherein the wall of the tundish further includes an electrically nonconductive reinforcement material.

6. The apparatus recited in claim 1, wherein said coil is fixed and said tundish is movable.

7. The apparatus recited in claim 1, wherein said coil is movable and the tundish is fixed.

* * * * *